US008006749B2

(12) United States Patent
Modi et al.

(10) Patent No.: US 8,006,749 B2
(45) Date of Patent: Aug. 30, 2011

(54) SEAL FOR TUBULAR HEAT EXCHANGER

(75) Inventors: Anil Kumar Modi, Maharashtra (IN); Veeravali Ramesh Nembilli, Maharashtra (IN); Venkatesh Murur, Maharashtra (IN)

(73) Assignee: Larsen & Toubro Limited (IN)

( * ) Notice: Subject to any disclaimer, the term of this patent is extended or adjusted under 35 U.S.C. 154(b) by 132 days.

(21) Appl. No.: 12/298,364

(22) PCT Filed: Apr. 20, 2007

(86) PCT No.: PCT/IN2007/000155

§ 371 (c)(1),
(2), (4) Date: Dec. 8, 2008

(87) PCT Pub. No.: WO2007/122632

PCT Pub. Date: Nov. 1, 2007

(65) Prior Publication Data

US 2009/0120608 A1 May 14, 2009

(30) Foreign Application Priority Data

Apr. 24, 2006 (IN) ..... 640/MUM/2006

(51) Int. Cl.
*F28F 9/02* (2006.01)

(52) U.S. Cl. ..... 165/158

(58) Field of Classification Search ..... 165/158
See application file for complete search history.

(56) References Cited

U.S. PATENT DOCUMENTS

| | | | | |
|---|---|---|---|---|
| 2,213,410 | A * | 9/1940 | Rathbun | 165/158 |
| 2,363,526 | A | 11/1944 | Hobbs | |
| 4,325,428 | A * | 4/1982 | Schuurman | 165/158 |
| 4,630,673 | A * | 12/1986 | Belleli | 165/158 |
| 5,755,277 | A * | 5/1998 | Appel et al. | 165/158 |
| 2007/0079956 | A1 * | 4/2007 | Howard | 165/158 |

FOREIGN PATENT DOCUMENTS

DE 202005012879 U1 10/2005

OTHER PUBLICATIONS

International Search Report as filed in International Application No. PCT/IN2007/000155.

* cited by examiner

*Primary Examiner* — Leonard R Leo
(74) *Attorney, Agent, or Firm* — Brooks Kushman P.C.

(57) ABSTRACT

Seal for tubular heat exchanger comprising groove with an inner edge; tongue of the diaphragm having front face extending in the radial direction and inner edge parallel to the axis of the channel; the face extending beyond the radial width of the groove in inward direction and overlapping the face of the shoulder of the channel in which the groove being provided. The tongue of the diaphragm being thus kept away from entering the groove; the diaphragm having flexibility to permit deflection of the tongue, the tongue of the diaphragm being loaded from outer side by the internal compression ring, the said internal compression ring being loaded in turn by the threaded push bolts/rods being fitted in the threaded holes on periphery of the threaded lock ring. This load is ultimately transferred to the joint between the gasket and face to achieve leak-proof joint.

1 Claim, 3 Drawing Sheets

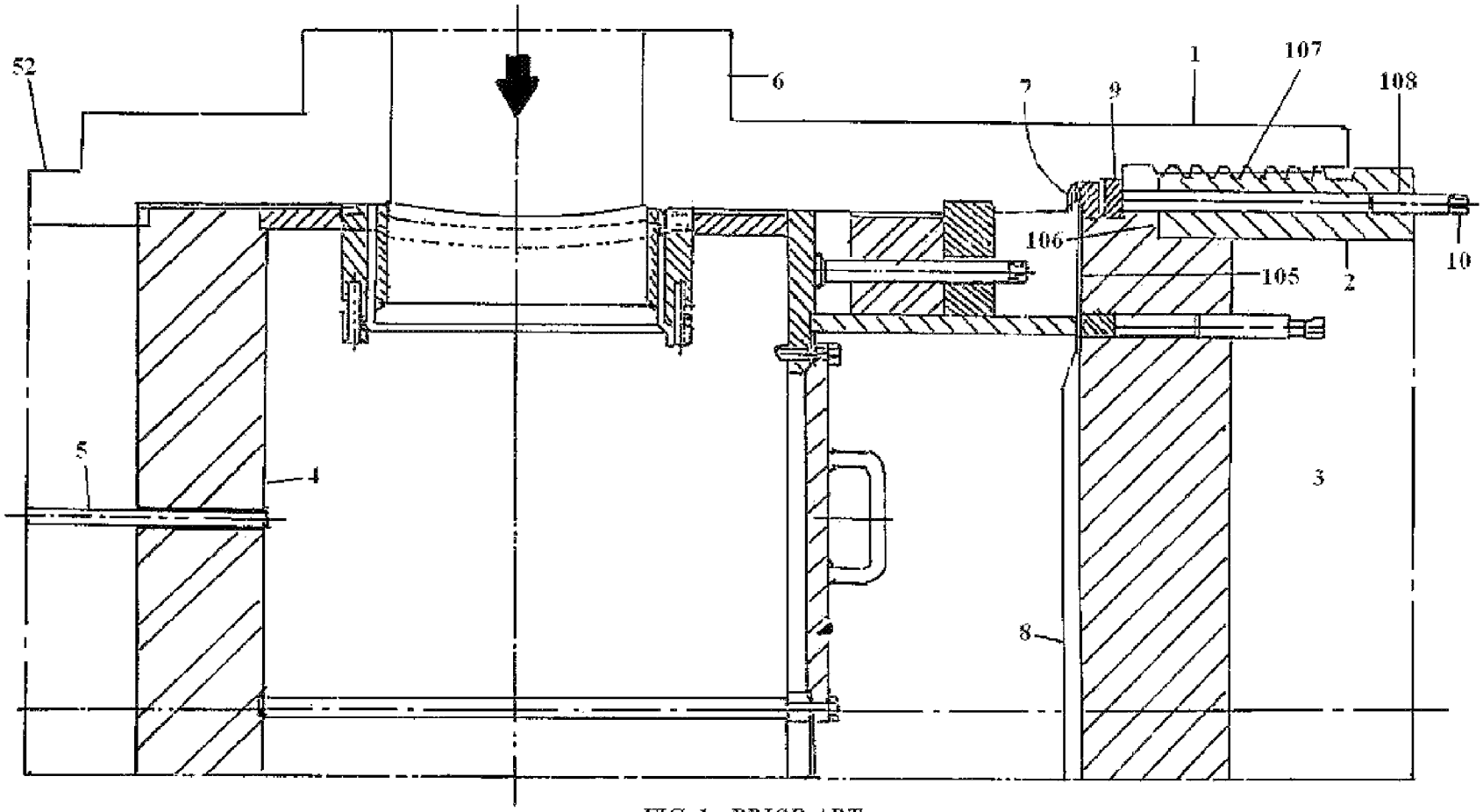
FIG. 1 - PRIOR ART

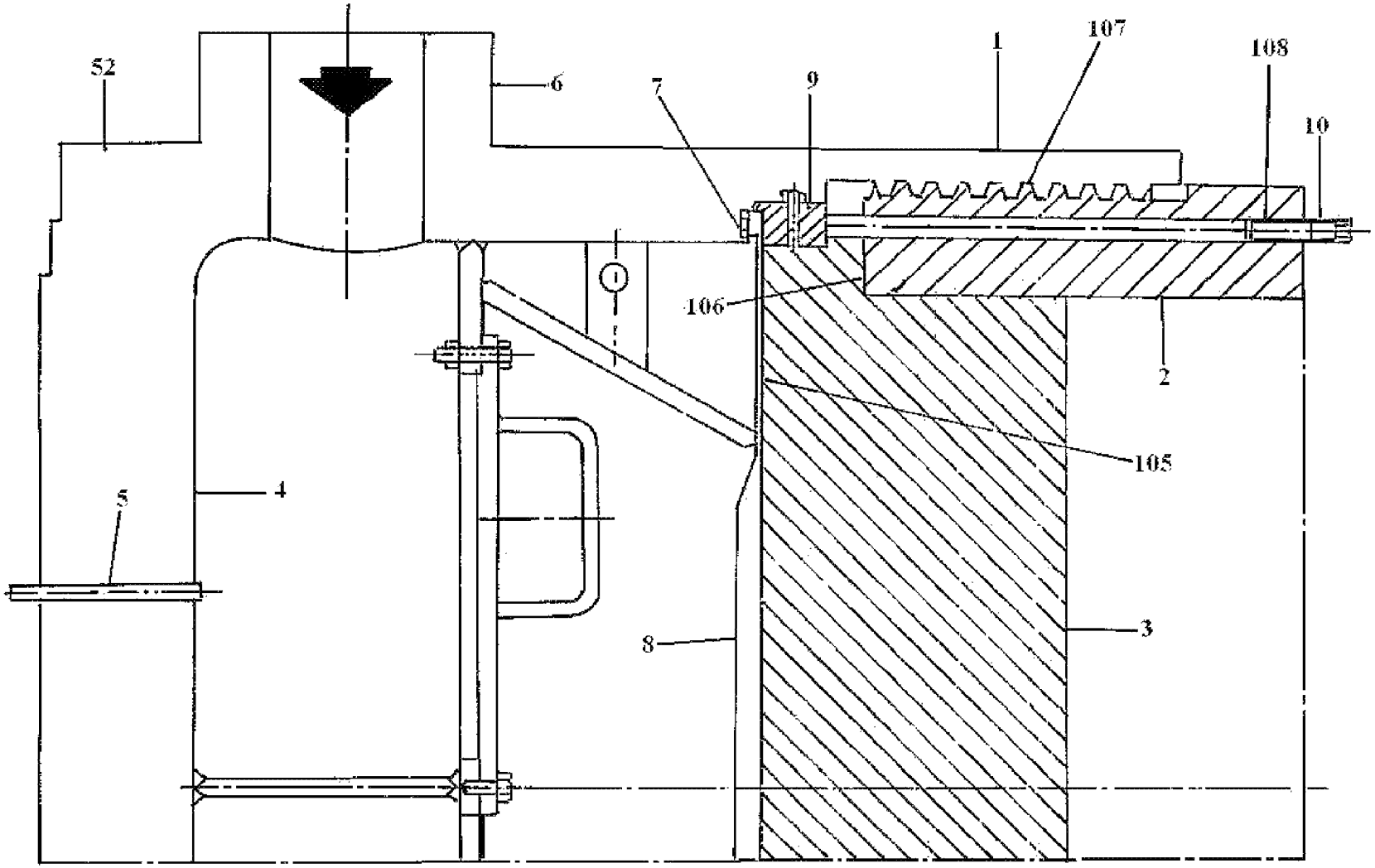
FIG. 2 - PRIOR ART

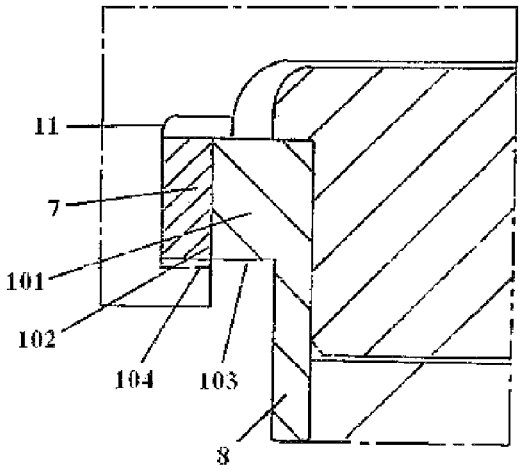
FIG. 3a - Prior Art
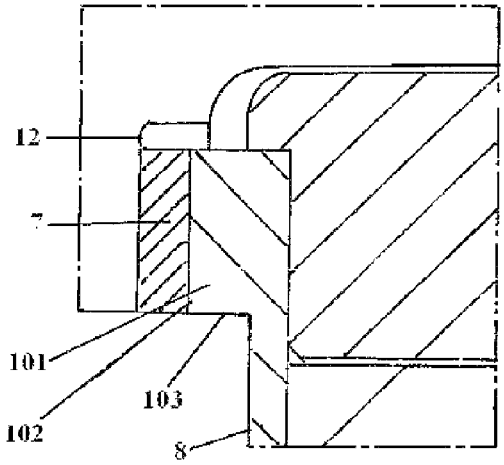
FIG. 3b - Prior Art
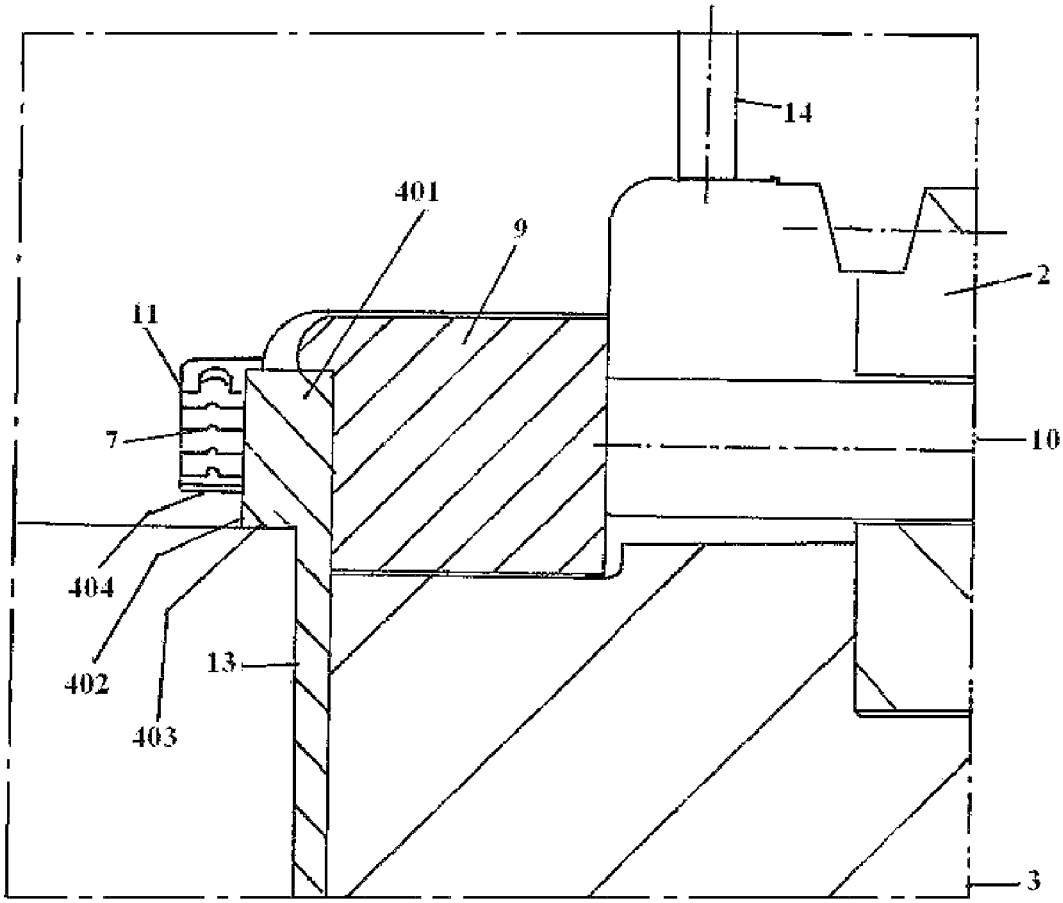
FIG. 4

SEAL FOR TUBULAR HEAT EXCHANGER

TECHNICAL FIELD

This invention relates to the threaded channel closure type shell and tube heat exchangers having removable tube bundles. These heat exchangers are widely used in critical services in process industries such as Hydrocracking units, Hydrotreating units, Hydrowaxing units, Hydrofining units etc.

BACKGROUND ART

The prior art is described with help of following figures.

FIG. 1 shows sectional view of H-H type heat exchangers described below.

FIG. 2 shows sectional view of the H-L type heat exchangers described below.

FIG. 3*a* shows the part sectional view of the gasketed joint in the channel header.

FIG. 3*b* shows the part sectional view of the gasketed joint in the channel header in its alternative arrangement.

Threaded channel closure type heat exchangers are generally classified based on the operating pressure on the shell side and tube side. The heat exchangers having high pressure on both the shell side as well as tube side are classified as H-H type heat exchangers, while the heat exchangers having lower pressure on shell side and high pressure on tube or channel side are classified as H-L type heat exchangers.

Due to these conditions, in case of H-H type heat exchangers the tubesheets themselves are subjected to lower differential pressure. Consequently, H-H type would typically have internal tubesheet with an apparatus for sealing of tubesheet against shoulder of the channel.

In H-L type, there being usually higher pressure on channel side and lower pressure on shell side, the tubesheets get typically exposed to high differential pressure. The tubesheets and channel covers in this case are typically of integral construction, either single piece or welded together.

Tubesheets are provided with plurality of holes in which tubes (5) are fixed. The channel is provided with nozzles (6) for the tube side fluid to enter and exit the heat exchanger. The heat exchangers are preferably provided with two or more tube passes. This is achieved by provision of partitions and covers inside the channel in a known way.

Both H-H and H-L type heat exchangers have channel headers (1) provided with closure consisting of a channel cover (3) and threaded lock ring (2) to retain the cover (3). The threaded lock ring (2) is screwed in the threads provided in the channel header body.

A gasketed joint is provided to seal the closure. A gasket (7) is located in the groove (11), in the shoulder of the channel as shown in FIG. 3*a*; or in an alternative arrangement, in the shoulder (12) formed in the channel as shown in the FIG. 3*b*. The gasket is compressed by peripheral portion i.e. tongue (101) of the diaphragm (8) which enters the groove (11) so as to compress the gasket. The diaphragm (8) is backed by a compression ring (9) at the periphery and the channel cover (3) in the central portion. The channel cover (3) is held in position by the threaded lock ring (2). The push bolts/rods (10) fitted in the threaded holes at the periphery of the threaded lock ring (2) pressurize the compression ring (9) when tightened. The compression ring in turn presses the tongue of the diaphragm to seal the gasket by pressurizing it. The end thrust due to the internal pressure on diaphragm is transmitted to the outer compression ring (9) and threaded lock ring (2) and resisted by it. The push bolts/rods 10) provide incremental loading of the gasket through diaphragm for keeping the joint leak-proof.

It can be seen from the above arrangement that, for obtaining the leak-proof joint the tongue (101) of the diaphragm has to enter the groove (11). Together with the heat exchanger, the diaphragm (8) has to undergo multiple number of pressure/temperature cycles over a period of time and makes it prone to distortion and deformation. This can cause the diaphragm to shrink in outer diameter thus pulling the inner edge (103) of the tongue (101) inwards, thus riding over the inner edge (104) of the groove (11) provided in shoulder of the channel, during retightening of the push bolts/rods (10). The metallic contact thus developed between the tongue (101) of the diaphragm (8) and inner edge (104) of the groove can obstruct transmission of load generated by tightening of the push bolts (10), thus only partly loading the gasket. Due to this the gasket is only superficially compressed which may cause continuous minor leaks, which not only can remain unnoticed but also can dangerously build up pressure beyond gasketed joint ahead of threaded portion of the channel header. This could lead to unsafe condition for the equipment with potential risk of disastrous accidents.

Considering the alternative arrangement as depicted in FIG. 3*b* wherein a shoulder (12) is provided in place of the groove (11), it can be readily seen that, this arrangement makes the gasket (7) unconfined at its inner diameter. This can lead to uncontrolled compression of the gasket making the joint unreliable and hence unsafe.

DISCLOSURE OF INVENTION

The present invention 'Seal for tubular heat exchanger' endeavors to eliminate the abovementioned drawbacks of the prior art.

The object of the present invention is avoiding the riding of the inner edge of the tongue of the diaphragm over the inner edge of the groove to make the joint reliable and leak proof.

Another objective of the present invention is to eliminate the pressure build up ahead of the threaded joint, which can lead to disastrous accidents.

This is achieved by extending the width of the tongue of the diaphragm so that the portion of the face of the tongue (towards the inner edge) rests on the face of the shoulder of the channel. In this case the tongue does not enter the groove in normal conditions. This arrangement ensures controlled compression of the gasket at the same time the gasket remains supported on inner as well as outer diameters and hence properly located concentric. Additionally when further load is applied on the tongue by retightening the push bolts through compression ring, the outer portion of the tongue which overlaps the groove is free to bend slightly (without permanent deformation) towards the gasket compressing it further and thus ensuring the gasketed joint remains effective.

As there is no additional seal provided after the said gasketed joint and clearances in the threaded parts are liberal, it can be easily concluded that, no safety arrangement is required in this portion. However, when in operation, the contact surface (105) between diaphragm and channel cover; the contact surface (106) between channel cover and threaded lock ring; the contact surface (107) between male threads of thread lock ring and female threads of channel header and the contact surface (108) between threads of the push bolts and tapped holes in threaded lock ring can become nearly leak-tight and thereby, creating nearly pressure-tight chamber. Due to this even a minor leakage through the gasketed joint can lead to accumulation of dangerous high pressure fluid in the aforesaid chamber ahead of threaded joint. This is eliminated by providing plurality of vent holes after the gasketed joint.

STATEMENT OF INVENTION

Seal for tubular heat exchanger comprising groove (11) with an inner edge (404); tongue (401) of the diaphragm (13) having front face (402) extending in the radial direction and inner edge (403) parallel to the axis of the channel; the face (402) extending beyond the radial width of the groove (11) in inward direction and overlapping the face of the shoulder of the channel in which the groove (11) being provided; the tongue (401) of the diaphragm (13) being thus kept away from entering the groove (11); the diaphragm having flexibility to permit deflection of the tongue, the tongue of the diaphragm being loaded from outer side by the internal compression ring (9), the said internal compression ring (9) being loaded in turn by the threaded push bolts/rods (10) being fitted in the threaded holes on periphery of the threaded lock ring (2); this load being ultimately transferred to the joint between the gasket (7) and face (402) to achieve leak-proof joint; plurality of vent holes (14) being provided after the gasketed joint and before thread lock ring so as to avoid pressure build up in case of leakage from the gasketed joint.

BRIEF DESCRIPTION OF DRAWINGS

The invention is now described with help of following figure.

FIG. 1 shows the sectional view of H-H type heat exchangers described below;

FIG. 2 shows sectional view of the H-L type heat exchangers described below;

FIG. 3*a* shows the part sectional view of the gasketed joint in the channel header;

FIG. 3*b* shows the part sectional view of the gasketed joint in the channel header;

FIG. 4 shows the part section of channel showing the gasketed joint in detail.

MODE(S) FOR CARRYING OUT THE INVENTION

The foregoing objects of the invention are accomplished and the problems and shortcomings associated with prior art techniques and approaches are overcome by the present invention as described bellow in the preferred embodiment.

This invention is illustrated in the accompanying drawings, through out which like reference letters indicate corresponding parts in the various figures.

Please refer to FIG. 4. The invention 'seal for tubular heat exchanger' comprises a groove (11) in the shoulder of the channel wherein a gasket (7) is fitted. The groove (11) has an inner edge (404). Tongue (401) of the diaphragm (13) has a front face (402) extending in the radial direction and inner edge (403) parallel to the axis of the channel. The face (402) is so arranged that, it extends beyond the radial width of the groove in inward direction and overlaps the face of the shoulder of the channel, in which the groove (11) is provided. The tongue (401) of the diaphragm is thus kept away from entering the groove (11) being bigger in face width than the groove itself. The tongue of the diaphragm (401) is loaded from outer side by the internal compression ring (9) which in turn is loaded by tightening of the push bolts/rods (10) fitted in the threaded holes on periphery of thread lock ring (2). This loads the joint between the gasket (7) and the face (402) of the tongue (401) to achieve leak-proof joint.

Plurality of vent holes (14) is provided after the gasketed joint and before the thread lock ring (2), so as to avoid any pressure build up, in case leakage occurs from the gasketed joint.

The foregoing objects of the invention are accomplished and the problems and shortcomings associated with prior art techniques and approaches are overcome by the present invention described in the present embodiment.

Detailed descriptions of the preferred embodiment are provided herein; however, it is to be understood that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or matter.

The embodiments of the invention as described above and the methods disclosed herein will suggest further modification and alterations to those skilled in the art. Such further modifications and alterations may be made without departing from the spirit and scope of the invention; which is defined by the scope of the following claims.

We claim:

1. A seal for a tubular heat exchanger comprising:

a channel header wherein a gasket is provided at a shoulder of a channel within a groove, the groove having an inner edge;

a tongue of a diaphragm having a front face extending in a radial direction and an inner edge of the tongue parallel to an axis of the channel, the front face extending beyond a radial width of the groove and in an inward direction and overlapping the shoulder of the channel in which the groove is provided, the tongue of the diaphragm being thus kept from entering the groove, the diaphragm having flexibility to permit deflection of the tongue;

an internal compression ring that loads the tongue of the diaphragm from an outer side of the diaphragm, the internal compression ring being loaded in turn by the a threaded push bolt being fitted in a threaded hole on a periphery of a threaded lock ring, this load being ultimately transferred to a joint between the gasket and the front face of the tongue to achieve leak-proof gasketed joint; and a vent hole being provided between the gasketed joint and the threaded lock ring so as to avoid pressure build up in case of leakage from the gasketed joint.

* * * * *